US009484639B1

(12) United States Patent
Chen

(10) Patent No.: US 9,484,639 B1
(45) Date of Patent: Nov. 1, 2016

(54) OPENABLE WIRE-MOUNTING CONNECTOR

(71) Applicant: Bingshui Chen, Xiamen (CN)

(72) Inventor: Bingshui Chen, Xiamen (CN)

( * ) Notice: Subject to any disclaimer, the term of this patent is extended or adjusted under 35 U.S.C. 154(b) by 0 days.

(21) Appl. No.: 15/043,387

(22) Filed: Feb. 12, 2016

(51) Int. Cl.
*H01R 4/24* (2006.01)
*H01R 4/16* (2006.01)

(52) U.S. Cl.
CPC ..... *H01R 4/16* (2013.01)

(58) Field of Classification Search
CPC .... H01R 4/48; H01R 4/4809; H01R 4/4818; H01R 4/4845
USPC ..... 439/436, 437, 438, 439, 440, 882, 780, 439/832, 833, 836, 818, 819
See application file for complete search history.

(56) References Cited

U.S. PATENT DOCUMENTS 8,328,586 B2 * 12/2012 Bies ..... H01R 4/4836 439/725
8,968,022 B2 * 3/2015 Mostoller ..... H01R 4/4836 439/438
9,209,530 B2 * 12/2015 Gassauer ..... H01R 4/4836
2011/0250775 A1 * 10/2011 Bies ..... H01R 4/4836 439/296
2011/0250803 A1 * 10/2011 Bies ..... H01R 4/4836 439/752.5
2014/0242833 A1 * 8/2014 Mostoller ..... H01R 4/4836 439/438
2014/0308855 A1 * 10/2014 Gassauer ..... H01R 4/48 439/682
2015/0357728 A1 * 12/2015 Chen ..... H01R 4/48 439/725

* cited by examiner

*Primary Examiner* — Hae Moon Hyeon

(57) ABSTRACT

An openable wire-mounting connector includes a body. A bottom of the body forms a welding face. A front of the body forms a wire entrance. Two sides of a rear of the body bend oppositely to form elastic clips which allow an insertion of a conducting wire and hold the wire in place. A top edge of each elastic clip forms a funnel-shaped mouth which opens upwards. A top end of the rear of the base bends firstly to form a curved limiting part and then bends upwards to form an elastic button. The curved limiting part presses down on the conducting wire to prevent the wire from escaping. The elastic button is located above the funnel-shaped mouth. The elastic clips can be opened by pressing the elastic button which activates the funnel-shaped mouth.

10 Claims, 3 Drawing Sheets

OPENABLE WIRE-MOUNTING CONNECTOR

BACKGROUND OF THIS INVENTION

1. Field of this Invention

This invention relates to a connector and relates particularly to an openable wire-mounting connector.

2. Description of the Related Art

Generally, a connector connected to a conducting wire usually has a complex structure. Although the wire can pass through the connector, it is difficult to withdraw the conducting wire from the connector. It usually needs tools or auxiliary devices to withdraw the wire successfully. This situation requires numerous operational steps and renders the structure more complex. Thus, this invention, which will be described as follows, is invented to solve the problems.

SUMMARY OF THIS INVENTION

An object of this invention is to provide an openable wire-mounting connector which simplifies the structure and attains a convenient insertion and withdrawal of the conducting wire.

To obtain the object, an openable wire-mounting connector of this invention includes a base. A welding face is formed at a bottom of the base. A wire entrance is formed at a front of the base. Two sides of a rear of the base bend toward opposite directions to form respective elastic clips which allow an insertion of a conducting wire and clamp the conducting wire for carrying out an electrical connection. A funnel-shaped mouth opens upwards from a top edge of each of the elastic clips. A top end of the rear of the base bends firstly to form a curved limiting part and further bends upwards to form an elastic button. The curved limiting part presses down on the conducting wire to limit the conducting wire and prevent the movement of the wire. The elastic button is located above the funnel-shaped mouth. The elastic clips can be opened by pressing the elastic button which activates the funnel-shaped mouth.

Preferably, the curved limiting part has a slot formed thereon along a direction from the front toward the rear of the base so that the curved limiting part can be provided with two press points.

Preferably, a bottom of the rear of the base bends inwards to form a lower elastic plate which pushes up against the conducting wire for carrying out the electrical connection.

Preferably, a recess is formed on the elastic button so that a small screwdriver can press down on the recess.

Preferably, a rear end of the elastic button further bends downwards and then inwards to form a press head. A lower end of the press head faces the funnel-shaped mouth and protrudes downwards to form at least one contact point.

Preferably, the base is in a shape of a rectangular tube.

Preferably, a weld-strengthening face is extended from the bottom of the rear of the base.

Preferably, the weld-strengthening face of the base has an annular shape to surround the lower elastic plate.

Preferably, the wire entrance formed at the front of the base has guiding faces.

Preferably, the base is made of a one-piece sheet whose two edges are bent to the bottom. Each of the edges also forms a groove and a lodging part lodged in the groove.

Preferably, a plastic casing can be further installed on the base. Sides of the base can have protrusions disposed thereon. A top and the sides of the base are covered by the plastic casing. There is an engagement between an inner wall of the plastic casing and the protrusions, the plastic casing can be fixed to the base. When the plastic casing is fixed to the base, the welding face of the base can be seen from a bottom of the plastic casing, and the elastic button can be seen from a rear of the plastic casing.

Preferably, the wire entrance at the front of the base forms guiding faces which bend outwards. A slanting wall is formed at a front of the plastic casing. The guiding faces each are hooked to the slating wall of the plastic casing to fix the plastic casing to the base.

By comparison with the conventional art, the base of this invention is easy and convenient to install, and the structure is simple. This invention takes advantage of the elastic clips to clamp the conducting wire when the wire enters the base and uses the curved limiting part to press down on the wire for limiting the wire. Thus, the escape of the conducting wire is prevented, and the electrical connection of the conducting wire is ensured. When the elastic button is pressed, the funnel-shaped mouth can be actuated to open the elastic clips, and the opening behavior of the elastic clips allows the conducting wire to be inserted and withdrawn repeatedly and also allows a convenient detachment of the conducting wire.

The advantages of this invention are more apparent upon reading the following descriptions in conjunction with the drawings.

DETAILED DESCRIPTION OF THE PREFERRED EMBODIMENTS

Figure 1:
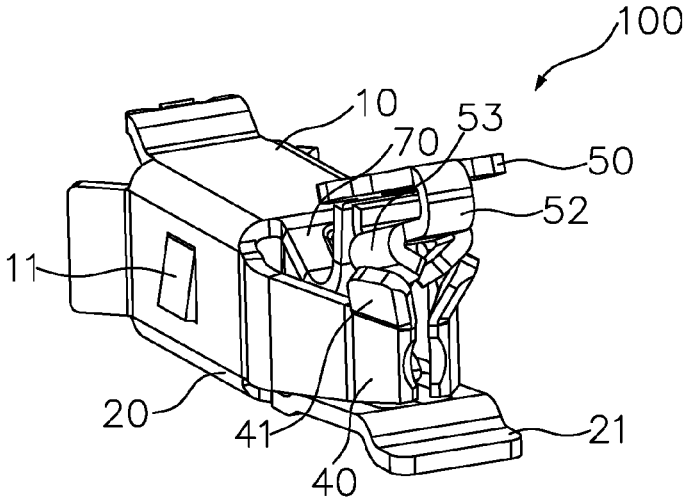
FIG. 1 is a perspective view showing a preferred embodiment of this invention.
Figure 2:
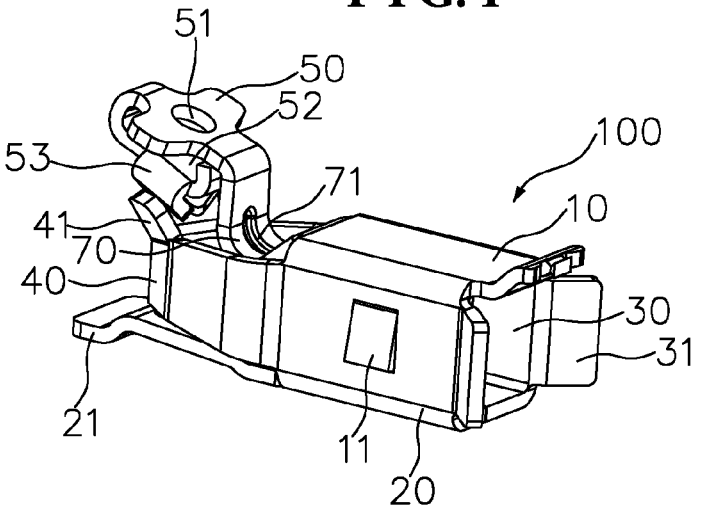
FIG. 2 is another perspective view showing the preferred embodiment of this invention.
Figure 3:
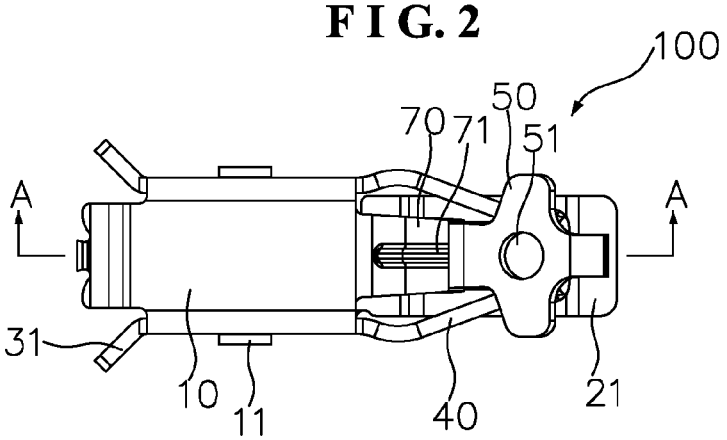
FIG. 3 is a top plane view showing the preferred embodiment of this invention.
Figure 4:
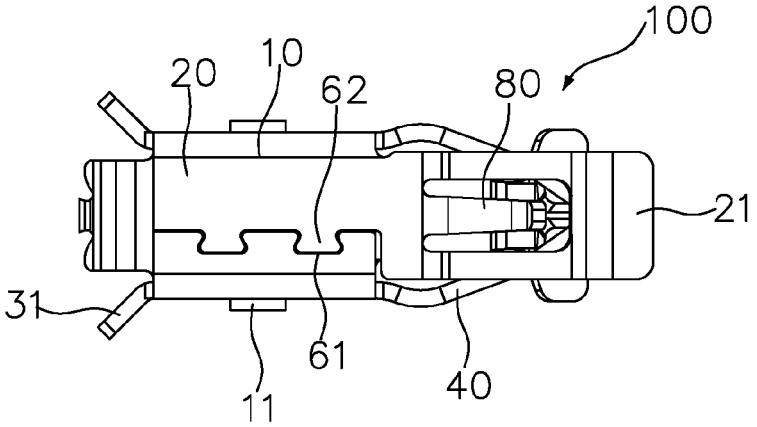
FIG. 4 is a bottom plane view showing the preferred embodiment of this invention.
Figure 5:
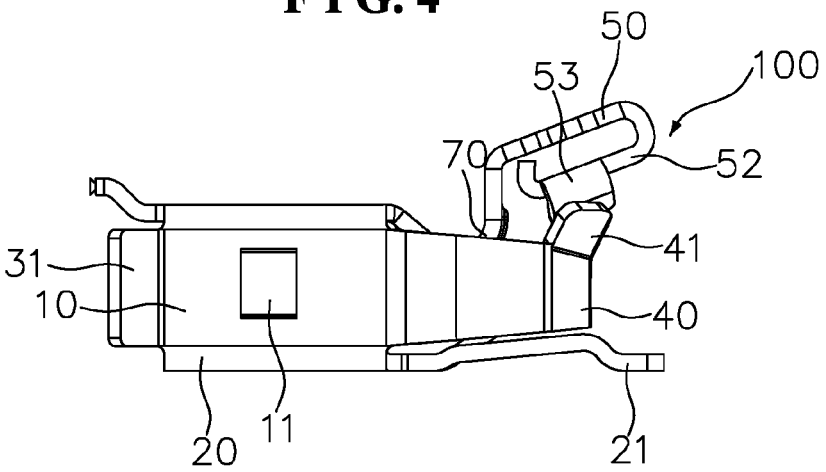
FIG. 5 is a side elevational view showing the preferred embodiment of this invention.
Figure 6:
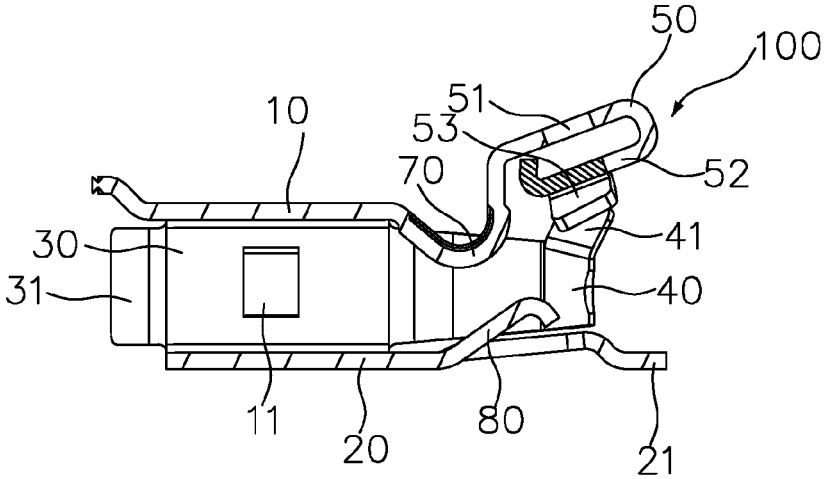
FIG. 6 is a cross-sectional view along the line A-A of FIG. 3.
Figure 7:
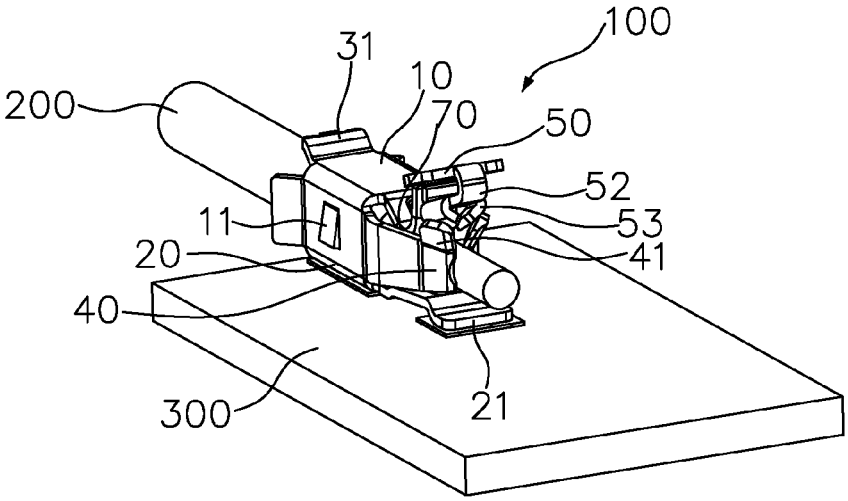
FIG. 7 is a perspective view showing that the preferred embodiment of this invention is equipped with a conducting wire.
Figure 8:
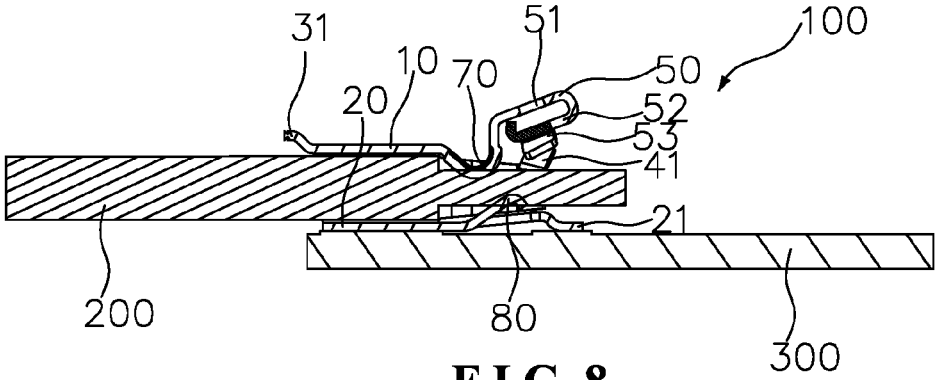
FIG. 8 is a cross-sectional view showing that the preferred embodiment of this invention is equipped with the conducting wire.
Figure 9:
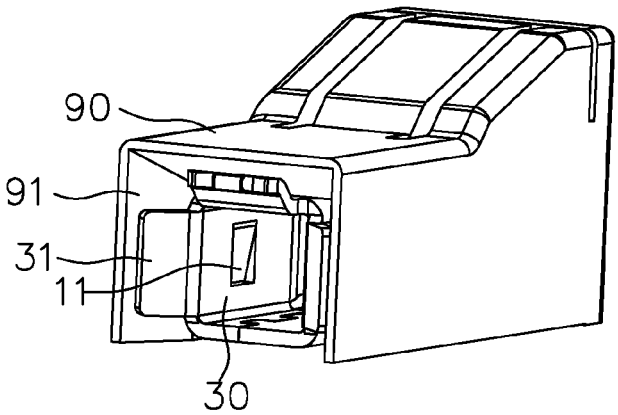
FIG. 9 is a perspective view showing that the preferred embodiment of this invention is equipped with a plastic casing.

Referring to FIGS. 1 to 9, an openable wire-mounting connector 100 of a preferred embodiment of this invention is shown and has a base 10. The base 10 in this preferred embodiment is in a shape of a rectangular tube.

A welding face 20 is formed at a bottom of the base 10. A weld-strengthening face 21 is further extended from a bottom of a rear of the base 10 to install more stably.

A wire entrance 30 is formed at a front of the base 10. There are guiding faces 31 formed on the wire entrance 30 at the front of the base 10 to allow an easy entry of a conducting wire 200.

Two sides of the rear of the base 10 bend toward opposite directions to form respective elastic clips 40. The conducting wire 200 can be inserted and firmly clamped between the elastic clips 40 to carry out an electrical connection. A top edge of each elastic clip 40 forms a funnel-shaped mouth 41 which opens upwards.

A top end of the rear of the base 10 bends firstly to form a curved limiting part 70. The curved limiting part 70 can press down on the conducting wire 200 to limit the conducting wire 200, thereby preventing the conducting wire 200 from escaping. In this preferred embodiment, a slot 71 is axially formed on the curved limiting part 70, specifically formed along a direction from the front toward the rear of the base 10. Thus, the curved limiting part 70 can have two press points whereby the movement or escape of the conducting wire 200 can be better prevented. The top end of the rear of the base 10 continues bending upwards, thereby forming an elastic button 50. The elastic button 50 is located above the funnel-shaped mouth 41. By the interaction between the elastic button 50 and the funnel-shaped mouth 41, the elastic clips 40 can be opened when the elastic button 50 is pressed. In order to press conveniently, on the elastic button 50 is formed a recess 51 on which a small screwdriver can press down. A press head 52 is further formed by bending a rear end of the elastic button 50 downwards and inwards. A lower end of the press head 52 faces the funnel-shaped mouth 41 and protrudes downwards to form at least one contact point 53. The contact point 53 can press the funnel-shaped mouth 41 to force the elastic clips 40 to open more easily.

In this preferred embodiment, it is preferable that the rear bottom of the base 10 further bends inwards to make a lower elastic plate 80. The lower elastic plate 80 can push up against the conducting wire 200 to provide an auxiliary contact effect. In other words, there is an additional point in electrical contact with the conducting wire 200 to render the electrical connection more reliable. In this preferred embodiment, the weld-strengthening face 20 of the base 10 can be annularly formed and located around the lower elastic plate 80. Therefore, all elements can be fully used to attain a dense structure and a lower lost.

The base 10 can be made of a one-piece sheet formed by bending to attain a simpler structure, reduce the usage amount of the material and lower the cost. Two edges of the sheet are bent to the bottom, and each of the edges also forms a groove 61 and a lodging part 62. There is a locking engagement between the groove 61 and the lodging part 62 to make sure that the sheet is well shaped by bending.

To complete the installation, a Surface Mount Technology (SMT) nozzle sucks the top of the base 10 to weld the welding face 20 and the weld-strengthening face 21 at the bottom of the base 10 to a circuit board 300, such as a Light Emitting Diode (LED) light board and a Printed Circuit Board (PCB) board. In use, a conducting wire 200 of a drive power enters from the wire entrance 30 of the base 10 toward the elastic clips 40. The elastic clips 40 then clamp the conducting wire 200 firmly. Concurrently, the curved limiting part 70 presses down on the conducting wire 200 to limit the wire 200 and prevent the wire 200 from escaping. The lower elastic plate 80 also pushes up against the conducting wire 200 to provide an auxiliary contact and obtain a steady and reliable electrical connection. To complete the detachment, a small screwdriver is used to depress the elastic button 50 so that the contact point 53 at the lower end of the press head 52 can fall into the funnel-shaped mouth 41. The contact point 53 then continues pressing down to force the elastic clips 40 to open. Thus, the clamping force which limits the conducting wire 200 can be eliminated, and the conducting wire 200 can be easily withdrawn.

Furthermore, the base 10 can be equipped with a plastic casing 90. The base 10 has protrusions 11 disposed at sides thereof. The top and the sides of the base 10 are covered by the plastic casing 90. The plastic casing 90 can be fixed to the base 10 by locking the protrusions 11 to an inner wall of the plastic casing 90. The welding face 20 at the bottom of the base 10 can be seen or revealed. In other words, the welding face 20, as shown, is not covered by a bottom of the plastic casing 90. The elastic button 50 in the rear of the base 10 can also be revealed. In other words, the elastic button 50 is not covered by a rear of the plastic casing 90. To fix the plastic casing 90 better, the wire entrance 30 at the front of the base 10 of this preferred embodiment has guiding faces 31 which bend outwards. A slanting wall 91 is formed at a front of the plastic casing 90. The guiding faces 31 of the base 10 which bend outwards can be hooked to the slanting wall 91 of the plastic casing 90 in order to fix the plastic casing 90 to the base 10.

While the embodiment of this invention is shown and described, it is understood that further variations and modifications may be made without departing from the scope of this invention.

What is claimed is:

1. An openable wire-mounting connector comprising a base, a welding face being formed at a bottom of said base, a wire entrance being formed at a front of said base, two sides of a rear of said base bending toward opposite directions to form respective elastic clips which allow an insertion of a conducting wire and clamp said conducting wire for carrying out an electrical connection, a funnel-shaped mouth opening upwards from a top edge of each of said elastic clips, a top end of said rear of said base bending firstly to form a curved limiting part and thence bending upwards to form an elastic button, said curved limiting part pressing down on said conducting wire to prevent said conducting wire from escaping, said elastic button being located above said funnel-shaped mouth, said elastic clips being opened by pressing said elastic button which activates said funnel-shaped mouth.

2. The openable wire-mounting connector according to claim 1, wherein said curved limiting part has a slot formed thereon along a direction from said front toward said rear of said base in order to form two press points.

3. The openable wire-mounting connector according to claim 1, wherein a bottom of said rear of said base bends inwards to form a lower elastic plate which pushes up against said conducting wire for carrying out said electrical connection.

4. The openable wire-mounting connector according to claim 1, wherein a recess is formed on said elastic button and allows a downward press of a small screwdriver.

5. The openable wire-mounting connector according to claim 1, wherein a rear end of said elastic button further bends downwards and then inwards to form a press head, a lower end of said press head facing said funnel-shaped mouth and protruding downwards to form at least one contact point.

6. The openable wire-mounting connector according to claim 1, wherein a weld-strengthening face is extended from a bottom of said rear of said base.

7. The openable wire-mounting connector according to claim 6, wherein said weld-strengthening face of said base is annularly formed, said bottom of said rear of said base bending inwards to form a lower elastic plate which pushes up against said conducting wire for carrying out said electrical connection, said weld-strengthening face surrounding said lower elastic plate.

8. The openable wire-mounting connector according to claim 1, wherein said wire entrance has guiding faces.

9. The openable wire-mounting connector according to claim 1, wherein said base is further equipped with a plastic casing, protrusions being respectively disposed on sides of said base, a top and said sides of said base being covered by said plastic casing, said protrusions being in engagement with an inner wall of said plastic casing to fix said plastic casing to said base, said welding face of said base being not covered by a bottom of said plastic casing, said elastic button being not covered by a rear of said plastic casing.

10. The openable wire-mounting connector according to claim 9, wherein said wire entrance forms guiding faces which bend outwards, a slanting wall being formed at a front of said plastic casing, said guiding faces of said base being hooked to said slating wall of said plastic casing to fix said plastic casing to said base.

* * * * *